US005139070A

United States Patent [19]

Kidd

[11] Patent Number: 5,139,070

[45] Date of Patent: Aug. 18, 1992

[54] SHADE FOR ARCHED OPENINGS USING SLIDE ROTATOR-ARM HINGE

[76] Inventor: Kenneth B. Kidd, 3722 W. Peoria Ave., Phoenix, Ariz. 85029

[21] Appl. No.: 605,933

[22] Filed: Oct. 30, 1990

[51] Int. Cl.[5] ..... E06B 9/30

[52] U.S. Cl. ..... 160/84.1; 160/134

[58] Field of Search ..... 160/84.1, 134, 279, 160/168.1, 330, 167, 321, 322; 416/70 A

[56] References Cited

U.S. PATENT DOCUMENTS

| | | | |
|---|---|---|---|
| 1,609,877 | 12/1926 | Kendall | 160/134 X |
| 3,386,106 | 6/1968 | Clemens | 160/84.1 X |
| 4,776,380 | 10/1988 | Lester | 160/134 |
| 4,858,669 | 8/1989 | Vinson | 160/84.1 X |
| 4,861,090 | 8/1989 | Gavrieli | 160/134 |
| 4,934,434 | 6/1990 | Schnebly et al. | 160/84.1 |
| 4,979,551 | 12/1990 | Schon | 160/84.1 |

*Primary Examiner*—David M. Purol
*Attorney, Agent, or Firm*—James F. Duffy

[57] ABSTRACT

An arched window opening may be shaded by rotating a shade through a segment of an arc. The slide rotator-arm hinging of the shade to permit its rotation from a position in which an accumulation of shading material is present beneath the hinge to one in which the shade material is distributed about a segment of an arc is disclosed.

2 Claims, 2 Drawing Sheets

SHADE FOR ARCHED OPENINGS USING SLIDE ROTATOR-ARM HINGE

BACKGROUND

1. Field of the Invention

The invention relates to the field of window shades; in particular, two window shades for use in arched window openings.

2. Prior Art

The prior art has been significantly unsuccessful in achieving window shades for use with arched windows. Past apparatus has been loaded with gimmickry to guide the edge of the shade through the arch contours. Such guiding devices have not only been inefficient, but they are generally visually distracting.

Another problem faced by designers of window shades for arched window openings is the fact that present day shade materials are generally sufficiently flimsy as to demand some attempt to maintain the arching window shade in position within the window opening. Such flimsy materials have led to the need for the unsightly guiding devices noted in the foregoing paragraph.

The intended purpose of the instant invention is to provide the means whereby an arched window opening may be shaded by drawing a shade through at least a segment of an arc.

SUMMARY OF THE INVENTION

The invention may be summarized as the improvement in a window shade for use in an arched window opening. The improvement itself comprises the means for rotating the shade through a segment of arc. It comprises a first slide rotator-arm hinge.

The slide rotator-arm hinge has a first rotary element rotatable for pivoting a pleated window shade through a segment of arc. The first flexible rotary element has a first end, a base to which the first end of the first flexible rotary element is pivotally coupled. A slide rotator arm is coupled to the first flexible rotary element.

The window shade is a pleated window shade coupled to the base and has a leading edge to be moved through a segment of arc for shading an arched window opening. The leading edge is coupled to the slide rotator arm. The window shade has a first disposition in which it is accumulated beneath the slide rotator arm and on the base. There is a second disposition in which the window shade is opened into a segment of arc for shading an arched window.

The combination (of the pivotal motion of the first flexible rotary element, with the first end pivotally coupled to the base, and the rotary slide arm on the first flexible rotary element) moves the slide rotator arm through a segment of arc, drawing the leading edge of the pleated window shade with it. The slide rotator arm appears to rotate about a center at the first end of the flexible rotary element even though the movement begins from a first disposition atop an accumulation of the pleated shade.

In a presently preferred embodiment of the invention, there are two pleated shades, each so movable through a segment of arc so as to shade an entire arched window opening, by shading adjacent segments of said opening.

A DETAILED DESCRIPTION OF THE INVENTION

Figure 1:
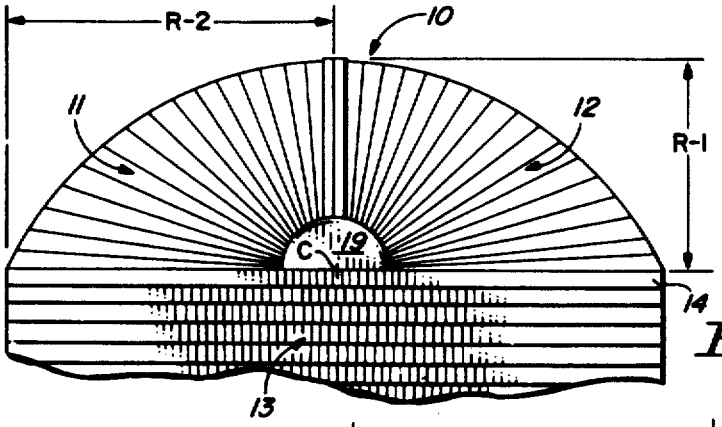
FIG. 1 illustrates a window having an arched opening at its top. The arch opening is shaded by the rotary shade apparatus disclosed herein. The arch of FIG. 1 is not a true semi-circle, being longer at its base than it is at its maximum height.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Figure 2:
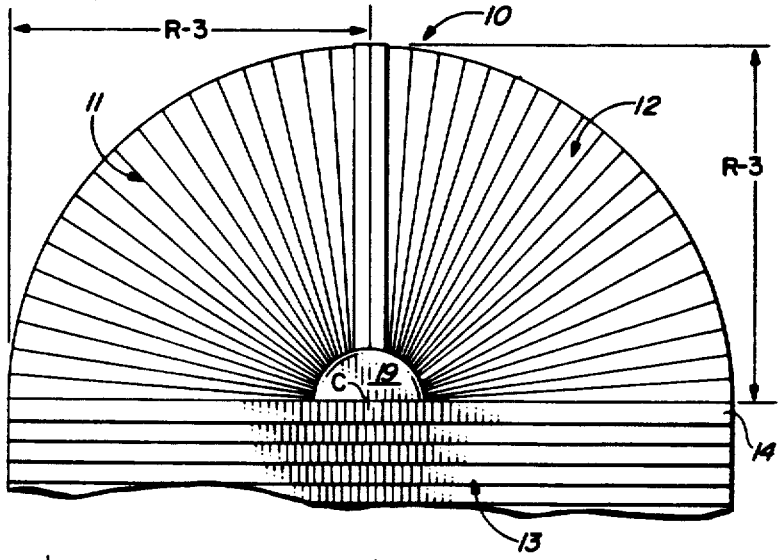
FIG. 2 is similar to the illustration of FIG. 1 with the exception that the arched opening is a true semi-circle and the height and the radius of the base are equivalent.
Figure 3:
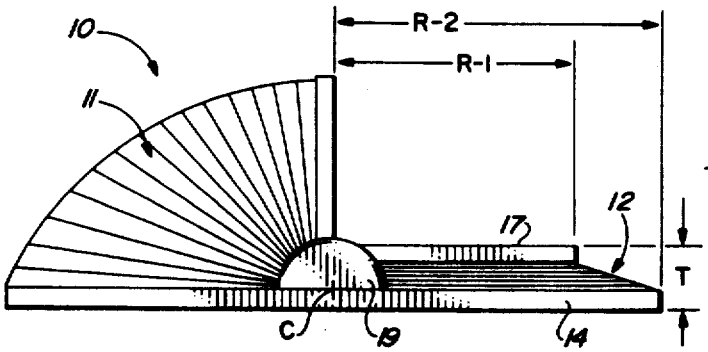
FIG. 3 illustrates the window shades for the arched opening of FIG. 1 wherein one of the shades has been raised for shading the arched window while the other is in its reclining position wherein light is allowed to travel through the window and into a room.

FIGS. 1, 2, and 3 illustrate the invention 10 as it is utilized when emplaced within an arched window opening. In a presently preferred embodiment of the invention, two shades, 11 and 12, each are employed to cover a segment of the arched window opening. Typically, arched window openings are emplaced above conventional rectangular window openings. A conventional shade 13 is employed to cover the windows in the rectangular opening. By way of example, and not of limitation, shades 11 and 12 are selected from those commercially available window shades which are pleated and thus assume a flat packaging envelope when the window is not shaded, and which expand easily and attractively to provide a light inhibiting, shade device for a window opening. The design and color of shade 13 will, in general, compliment that of shades 11 and 12.

FIG. 1 is presented to show the use of the invention 10 within an arched window opening wherein the base 14 of the device lies on the cord of a circle rather than along the diameter of a circle. In such an instance, as depicted in FIG. 1, the height of the arched opening, R-1, is shorter in dimension than the horizontal radius R-2. The opening and closure of shades 11 and 12 will be seen to apparently coincide with a rotary center C.

In FIG. 2, the use of the invention 10 within a full semi-circular, arched opening is illustrated. In this instance, the maximum height of the invention 10, as well as the horizontal radius, are each equivalent to a dimension R-3.

The illustration of FIG. 3 shows the invention 10 in the embodiment depicted in FIG. 1. However, in FIG. 3, shade 12 has been rotated downwardly to admit light through the arched window opening. The means whereby rotation is achieved are concealed from view behind cosmetic shield 19. Rotator arm 17, more generally referred to as a slide rotator arm, provides the means for drawing shade 12 in rotation about center C in opening and closing shade 12. Note that in embodying invention 12 to fit into an arched window opening in which the base 14 lies along the cord of a circle, shade 12 tapers in dimension from a length equal to that of slide rotator arm 17 to that of a length approximating half the length of base 14. Slide rotator arm 17 is part of a slide rotator-arm hinge to be disclosed in greater detail hereinafter. The problem to be overcome in attempting to utilize a hinge is the fact that shades 11 and 12, when adjusted to admit light through a window, accumulate a significant thickness T of material, as seen in the instance of shade 12 as depicted in FIG. 3. The hinge derived for overcoming the difficulty encountered by this accumulation of a thickness T of material in either of shades 11 or 12 when the window is unshaded is presented in the drawings of FIGS. 4–6.

Figure 4:
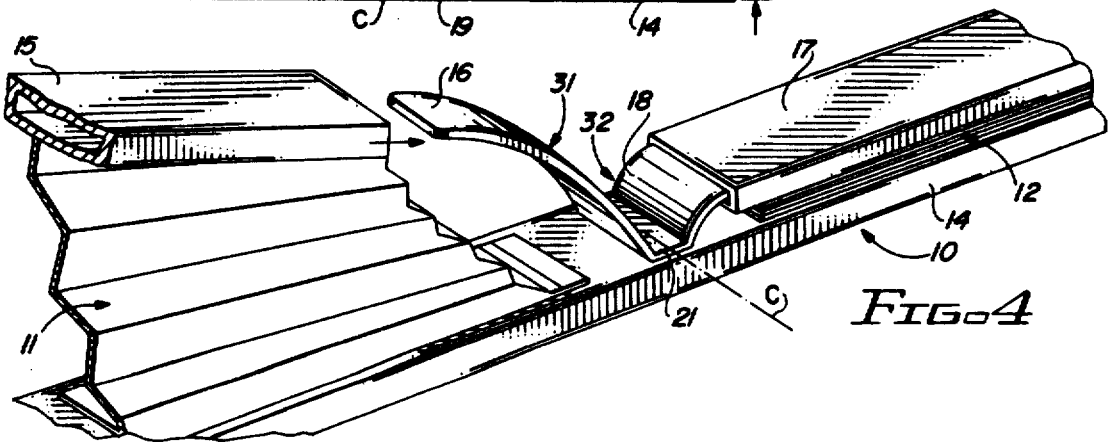
FIG. 4 is a detailed drawing illustrating the slide rotator-arm hinge of the invention. Two such hinges are illustrated, as well as the manner in which the slide rotator arm is slidingly coupled to the hinge element.

FIG. 4 represents the heart of the invention 10, a slide rotator-arm hinge 31. The hinge itself is comprised of two elements, a first element being fixed with respect to a second element. In the embodiment herein described, the two elements of the hinge, for example, fixed element 21 and rotary element 16, achieve the hinged rotary effect as a result of the flexibility of hinge element 16. In FIG. 4, two such hinges 31 and 32 are shown, each sharing the same fixed hinge element 21, thus element 16 and 21 comprise a first hinge 31, elements 18 and 21 comprise a second hinge 32. Rotator slide arms 15 and 17 are slide coupled to their respective hinge elements, 16 and 18, respectively. Shade 11 is coupled to base 14 and to slide rotator arm 15. As slide rotator arm 15 rotates about the apparent center C, the leading edge of shade 11 is drawn by rotator arm 15 through a segment of an arc.

Shade 12, in FIG. 4, is in the nominal position in which the window, in which the invention is utilized, is unshaded. Thus, there is an accumulation of shade material 12, in a thickness equivalent to T between rotary arm 17 and base 14. Rotary arm 17 is more aptly described as a slide rotator arm because of the fact that it is slide coupled to hinge element 18; just as is slide rotator arm 15 to hinge element 16. Thus, when the window is unshaded and the shade material accumulates to a thickness of T, the slide rotator arm slides upward along the flexible hinge element to accommodate the buildup of material between the arm and the base. This is illustrated in FIGS. 4 and 5 wherein slide rotator arm 17 has moved upwards along the length of hinge element 18 and away from the apparent center of rotation C.

Figure 5:
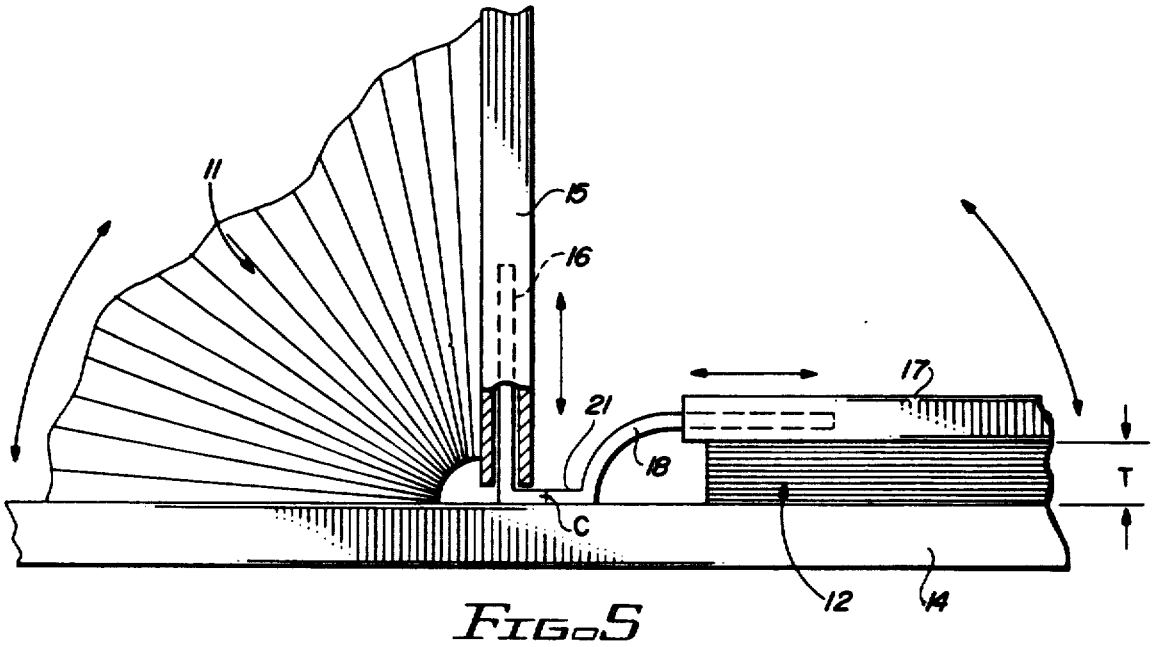
FIG. 5 is a front elevational view showing the workings of the slide rotator-arm hinge in detail.

When a rotator arm is drawn upward through a segment of an arc, as illustrated with rotator arm 15 in FIG. 5, the shade, here 11, is drawn through that segment of arc and the rotator arm slides downwardly along its hinge element to come into contact with the fixed hinge element 21 adjacent the apparent center of rotation C. Note that it is the force of gravity which has drawn rotator arm 15 downwardly toward hinge element 21 in FIG. 5. It is the combination of the pivotal motion of hinge element 16 with respect to fixed hinge element 21, or, as appropriate, flexible hinge element 18 with respect to fixed hinge element 21, which permits the slide rotator arms to move through the segment of arc and apparently rotate about the center C even though the rotator arms, 15 and 17, begin from a position atop an accumulation of shade material, 11 and 12, having a thickness T.

It has been noted that the present day shade material suitable for use as shades within arched window openings is so flimsy that guiding devices are required to maintain the shade within the arched opening. The invention avoids this problem by utilizing two slide rotator-arm hinges adjacent one to the other as illustrated in FIGS. 4 and 5. Since, with two adjacent hinges, the shades 11 and 12 need move through only one-half of the arch, the problem of the flimsiness encountered when attempting to draw the shade through larger segments of arc is eliminated. Thus, the use of the invention with two adjacent slide rotator-arm hinges is advocated as presently preferred. However, in anticipation that shade materials will eventually be made available, suitable for use in arched windows, and having sufficient body to retain their shape and position when drawn through the entire arc of the archway, the embodiment of FIG. 6 is offered.

Figure 6:
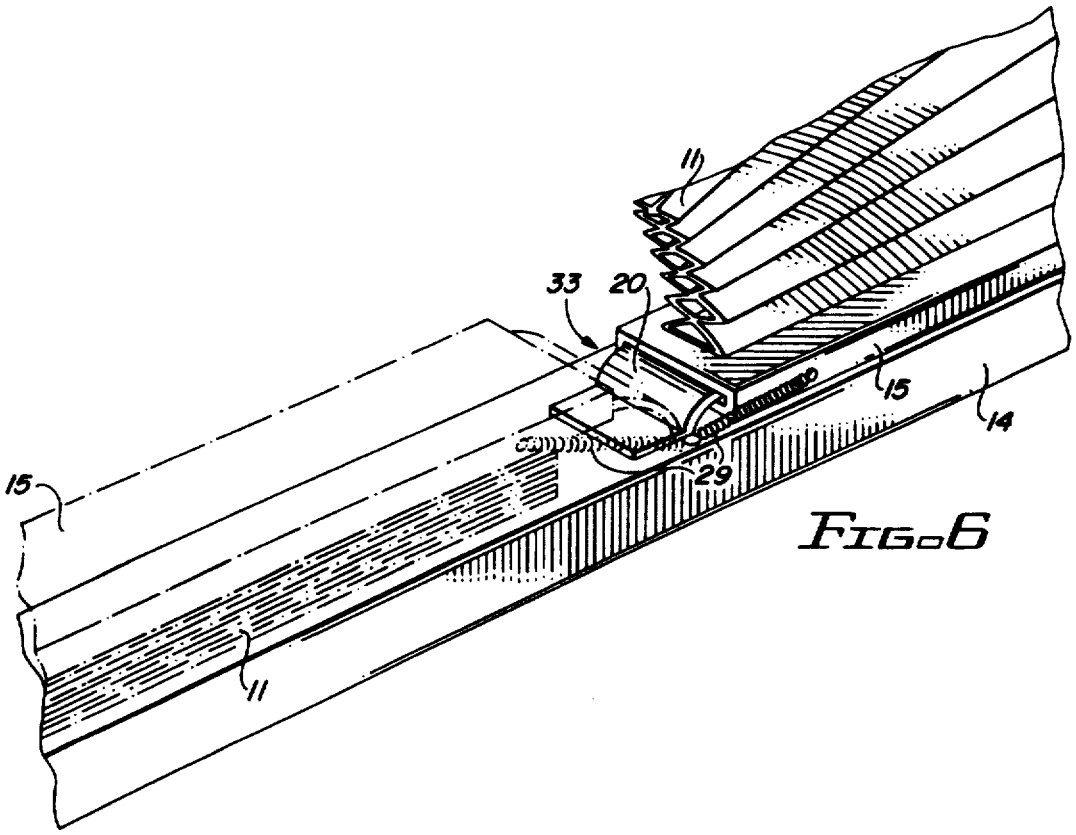
FIG. 6 is a perspective detail of a single slide rotator-arm hinge which includes springs to retain the slide rotator arm in position on the hinge element as the arm rotates through approximately 180° of arc.

In FIG. 6, a single slide rotator-arm hinge 33 is illustrated. The hinge comprises rotator arm 15 and flexible hinge element 20. To the left of the illustration, shown in phantom outline, the shade 11 is shown withdrawn to allow light to pass through the window opening and into the room. Upon rotation of rotor arm 15 through approximately 180° of arc, as illustrated in the solid outline of FIG. 6, the shade 11 is drawn through the complete arc necessary to shade the entire arched opening. To retain rotator arm 15 slide coupled to flexible hinge element 20 as the rotator arm 15 moves through approximately 180° of rotation, spring 29 is provided coupling rotator arm 15 to base 14. In practice, a pair of springs 29, one at each side of rotator arm 15, will be employed.

What has been disclosed herein is the means and method whereby an arched window opening may be shaded by rotating a shade through a segment of an arc. The hinging of the shade to permit its rotation from a position in which an accumulation of shading material is present to one in which the shade material is distributed throughout a segment of arc is disclosed.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention,:

1. In a first window shade for use in an arched window opening including means coupled to said shade for rotating said shade through a segment of arc, the improvement comprising:

said means for rotating said shade through a segment of arc comprises a first slide rotator-arm hinge;

said slide rotator-arm hinge has a first flexible rotary element rotatable for pivoting a pleated window shade through a segment of arc, said first flexible rotary element having a first end;

a base to which said first end of said first flexible rotary element is pivotally coupled;

a slide rotator arm slidingly coupled to said first flexible rotary element; and said first window shade being a pleated window shade coupled to said base and having a leading edge to be moved through a segment of arc for shading an arched window opening;

said pleated window shade having said leading edge coupled to said slide rotator arm and having a first disposition in which said window shade is accumulated beneath said slide rotator arm and on said base, and a second disposition in which said window shade is opened into a segment of arc for shading an arched window;

whereby the combination of the pivotal motion of said first flexible rotary element, with respect to said first end pivotally coupled to said base, and the sliding displacement of said rotary slide arm on said first flexible rotary element moves said slide rotator arm through a segment of arc, drawing said leading edge of said pleated window shade with it, said slide rotator arm appearing to rotate about a center at said first end of said flexible rotary element even though said movement begins from a first disposition atop an accumulation of said pleated shade.

2. The improvement of claim 1 further comprising:

a second said slide rotator-arm hinge, each said first and second hinge being pivotally coupled to said base adjacent one to the other; and a second said pleated window shade coupled by its leading edge to the slide rotator arm of said second slide rotator-arm hinge whereby adjacent segments of arc of an arched window opening may be shaded by said window shades.

* * * * *